United States Patent [19]

Fenoglio et al.

[11] Patent Number: 4,879,018

[45] Date of Patent: Nov. 7, 1989

[54] LOW VOLTAGE ANODIZING PROCESS AND APPARATUS

[76] Inventors: Charles Fenoglio, 6690 7 Mile Rd., South Lyon, Mich. 48178; Peter Kljucaricek, 6732 Lozier, Warren, Mich. 48091; Jeffrey Pernick, 3504 Edgewood Park Dr., Commerce Township, Oakland County, Mich. 48085; Fred C. Schaedel, 12812 Valley View #18, Garden Grove, Mich. 92645

[21] Appl. No.: 943,510

[22] Filed: Dec. 19, 1986

[51] Int. Cl.[4] ..... C25D 11/00; C25D 21/00

[52] U.S. Cl. ..... 204/56.1; 204/58.5; 204/228

[58] Field of Search ..... 204/56, 58, 228

[56] References Cited

U.S. PATENT DOCUMENTS

| | | | |
|---|---|---|---|
| 3,418,222 | 12/1968 | Schaedel | 204/58 |
| 3,597,339 | 8/1971 | Newman et al. | 204/58 |
| 3,708,407 | 1/1973 | Newman et al. | 204/56 |
| 3,975,254 | 8/1976 | Elco et al. | 204/228 |
| 3,983,014 | 9/1976 | Newman et al. | 204/58 |
| 4,026,781 | 5/1977 | Newman et al. | 204/228 |
| 4,478,689 | 10/1984 | Loch | 204/14.1 |
| 4,517,059 | 5/1985 | Loch et al. | 204/14.1 |

*Primary Examiner*—John F. Niebling
*Assistant Examiner*—Kathryn Gorgos
*Attorney, Agent, or Firm*—William L. Fisher

[57] ABSTRACT

A low voltage anodizing process for anodic oxidation of metals in which are used: (i) an anodizing bath containing an electrolyte, an anode and a cathode; and (ii) and AC fed DC power supply for supplying pulsating DC power to the anodizing bath; the anodizing process comprising cyclicly discharging the inherent capacitance in the anodizing bath; such cyclic discharge of such inherent capacitance being accomplished by providing successive power cycles wherein each such power cycle consists of a rise portion followed by a fall portion followed by an off-time portion; and providing a shunt discharge path in electrical circuit across the anode and cathode and being external to the anodizing bath for discharging such inherent capacitance during the last part of such fall portion and all during such off-time portion of each power cycle, a significant fraction of the total anodizing current being shunted across such discharge path which is large enough to completely discharge such inherent capacitance and to empty it of accumulated charges thereon prior to the rise portion of the next subsequent power cycle, there being no capacitor in electrical circuit across the anode and cathode and external to the anodizing bath.

2 Claims, 1 Drawing Sheet

LOW VOLTAGE ANODIZING PROCESS AND APPARATUS

Our invention relates to anodic oxidation of metals, commonly called anodizing.

The principle object of our invention is to capitalize upon a new and amazing discovery we made in this art which produces truly revolutionary beneficial results.

We discovered that there is a capacitance inherent in the process of anodizing aluminum and that all during the anodizing process the lead cathode (through the sulphuric acid electrolyte) is one plate of a capacitor while the aluminum part (anode) is the other plate, and the aluminum oxide being formed is the dielectric.

We provide a shunt discharge means (herein SDM) and a pulsed D.C. power supply to produce cyclic alternate charge and discharge of this inherent capacitor. Such cyclic alternate discharge takes place across the shunt discharge means which is placed across the anode and cathode (in parallel with the inherent capacitance). We have confirmed the benefit of cyclic alternate charge and discharge of this capacitor during each cycle of the power supply by: (a) the oscilloscope picture of the power supply wave form which changes from a relatively complex wave form to a simple recognizable pulsed wave form somewhat as that shown in FIG. 4; and (b) the metal oxide forming on the metal part to be anodizied is formed with much lower voltages (less than 50% of those required in the prior art). The metal oxide is now formed not only at lower voltage but with ease because we alternately discharge this capacitor each time before we charge it so that it is always empty of accumulated charges during each increment of charging. Because this increment of charging always occurs in our invention with an empty capacitor, lower voltages are required to maintain the current needed to effect the required chemical reactions in the bath to form the oxide coating desired. Using said low voltages, we are able to form metal oxide coatings to thicknesses heretofore unachievable in the prior art and with less anodizing time. In the case of anodizing aluminum, the aluminum oxide formed is of controllable quality as to porosity and strength, and this has not been achieved heretofore in the prior art. As a consequence aluminum parts which have been over-machined (and which would otherwise have to be scrapped) can be salvaged at great savings by building up high quality coatings to mil thickness (up to as much as 20 mils) heretofore unachievable in the prior art.

We wish to secure for ourselves the benefit of a patent for the novel process and apparatus which we have provided as a consequence of our discoveries. Such process and apparatus we disclose herein.

Figure 1:
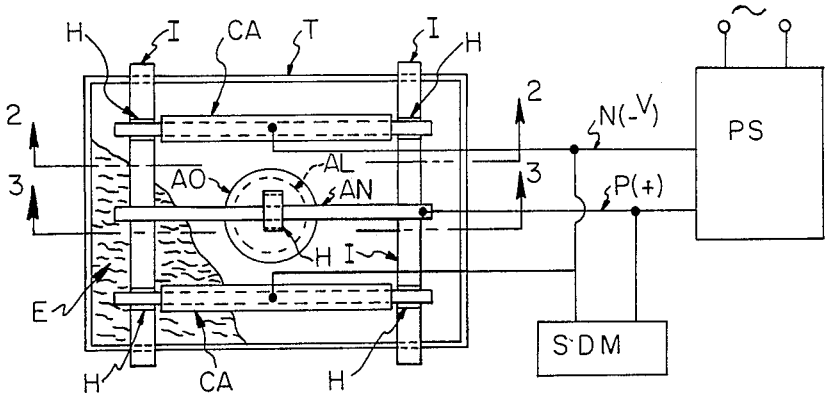
Figure 2:
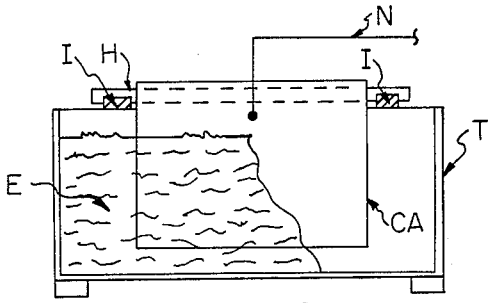
Figure 3:
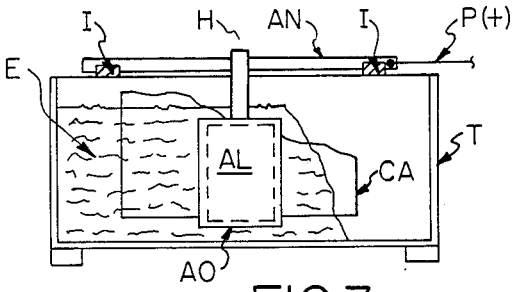
Figure 4:
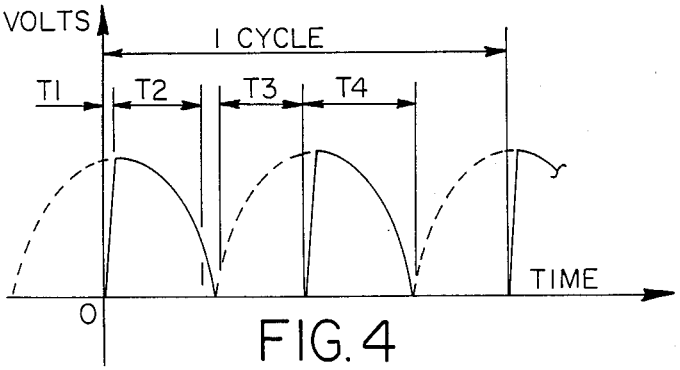
Figure 5:
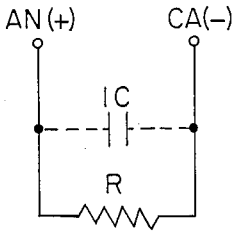

Our invention, and the advantages thereof, will become apparant during the following description, taken in conjunction with the accompanying drawings, in which:

FIG. 1 is a plan view of anodizing apparatus equipped with our invention;

FIGS. 2 and 3 are respective vertical sectional views of the structure of FIG. 1 taken, respectively, on the lines 2—2 and 3—3 thereof;

FIG. 4 is a schematic view of a suitable rise/fall/off-time wave form we have used with our invention; and FIG. 5 is a schematic view showing a shunt discharge means used in our invention.

Referring to the drawings in greater detail, anodizing apparatus is shown therein equipped with our invention which comprises:

(a) a rise/fall/off-time AC fed DC power supply having in each power cycle alternating rise/fall/off-time portions;

(b) said rise/fall/off-time portions being present in each cycle over the entire range of anodizing voltage (that is, at minimum and maximum anodizing voltages and at all anodizing voltages in between); and (c) shunt discharge means SDM across the anode and cathode in parallel with said inherent capacitance for cyclicly alternately discharging said capacitance. Such shunt discharge means can be selected by experimentation to see what rate of capacitive discharge thereacross is most desirable for meeting the specific coating requirement and in particular, the strength and porosity of said coating. In the case of a low resistance device used for said SDM, the ohmage thereof can be determined, for example, by selecting that resistance which produces the largest initial anodizing current in the bath at the lowest starting voltage for the particular application.

The following legend explains the symbols shown in the drawings: "AL" is aluminum, "AN" is the anode, "AO" is aluminum oxide, "C" is a capacitor, "CA" is for cathode (lead), "E" is the electrolyte, "H" are hangers, "I" is for insulator, "IC" is for inherent capacitance, "L" is an inductor, "N"is the negative DC output line, "P" is the positive DC output line, "PS" is a DC power supply used in our invention, "R" is a resistor and "SDM", as already mentioned, is the shunt discharge means across the anode AN and cathode CA in parallel with said inherent capacitance IC, "TC" designates the tank for containing the electrolyte and supporting the anode AN, cathode CA and the aluminum part AL being anodized, "T1" is rise time; "T2" is fall time; and "T3" is off-time.

FIG. 4 illustrates a suitable rise/fall/off-time wave form which is produced from a DC power supply PS consisting of a single phase full wave rectifier having an SCR controlled secondary (two SCRs) which produces variable DC output voltages from 0/50/100/150 volts. The rise portion is indicated as "T1"; the fall portion as "T2"; and the off-time as "T3". The time period consisting of a time prior to the time "T3" plus the time "T3" is when capacitive discharge occurs.

In the prior art, the voltages required to form a given mil thickness of coating are far higher than is the case with our invention. Also, with our invention, because of the lower anodizing voltages used, there is no danger of breakdown of the coating during the entire anodizing run, whereas this is not so with the prior art. The prior art process must be carefully observed and the applied voltage periodically "backed-off" to prevent sudden current rises which signal danger of puncturing of the coating being formed.

We have termed our new discovery, "LVA" (Low Voltage Anodizing), which term we wished used whenever reference is made thereto.

The following Examples I to III of hard coat anodizing further disclose our invention.

A 2 ohm resistor was placed across the anode and cathode outside the anodizing bath. Immediately, surprising results were obtained as shown in Example I below.

EXAMPLE I

Aluminum oxide was being anodically formed on an aluminum test panel (alloy 6061) as the load and while using 22% sulphuric acid as the electrolyte and lead cathodes and while using the previously mentioned 0/50/100/150 volt output DC power supply PS1, full anodizing current was suddenly attained while the anodizing process was at low (about 15 volts) voltages. The oscilloscope picture immediately changed from a complex (irregular, zig-zag, non-saw-tooth) to a clean wave form (that is, a rise/fall/off-time saw-tooth pattern comparable to that shown in FIG. 4) and remained clean throughout. We completed the full anodizing run by step-wise increases in voltage up to about 30 volts and achieved, with ease, 2 mils of coating (0.002 inches) of excellent quality in 50 minutes with no indication at all of sudden current increase as happens in the prior art.

EXAMPLE II

Using a rise/fall/off-time single phase DC power supply having an SCR controlled secondary having a 40 volt maximum output and a shunt resistor of 0.2 ohm (22% sulphuric acid bath at 30° F.), we achieved a 2 mil coating on aluminum parts, including two test panels (aluminum alloy 6061), in 10 five minute steps with a maximum voltage of less than 31 volts (as compared to 75 volts in the prior art; see Example IV). The accumulated output DC kilowatt-hours were approximately 155 (output kilowatt hours). The sudden current rises mentioned (which in the prior art are such that they tend to break down the coating) were entirely absent. The following observations were noted.

Example II Table

| DC Volts | Total Current (Amps) (including shunt current) | Time (min.) | Shunt Current (Amps) |
|---|---|---|---|
| 14.5 | 620 | 0 | 83.6 |
| 15.4 | 710 | 5 | 89.6 |
| 15.9 | 710 | 10 | 92.8 |
| 17.4 | 800 | 15 | 102.4 |
| 19.0 | 800 | 20 | 112.4 |
| 20.6 | 850 | 25 | 122.8 |
| 21.8 | 850 | 30 | 130.4 |
| 23.2 | 840 | 35 | 140.4 |
| 24.8 | 840 | 40 | 151.2 |
| 27.4 | 840 | 45 | 167.6 |
| 30.6 | 840 | 50 | 189.6 |

It should be noted that in Example II above, the anodizing current desired for the particular load was reached immediately. Also, that the shunt current through the SDM is a significant fraction (between about 12 and 22 percent) of the total anodizing current.

EXAMPLE III

Using the same power supply as used in Example I, but with a small aircraft part as the load (an aluminum hydraulic manifold) in need of repair (which required 7.6 mils of additional coating) and using a wire wound resistor as the shunt discharge means, we set out to produce the needed coating. We increased the voltage in about 35 steps from about 5 volts to about 21 volts maximum without any worry (because of such low voltage) of break down of the coating signalled by sudden current rises. We immediately reached starting anodizing current (2 amperes) and finished with a final current of 1 ampere. We achieved a 7.6 mil coating of excellent quality in about 3 hours. Such an achievement in the prior art, if possible, would require higher voltages, more time and much patience (with constant observation and periodic "backing-off" of the applied voltage) to prevent danger of puncturing of the coating signalled by sudden current rises.

EXAMPLE IV (PRIOR ART)

Using a non-rise/fall/off-time DC power supply consisting of a rectifier having a zero to seventy-five volt DC output range and a 6 phase "star" SCR controlled secondary having overlapping output pulses (no off-time) in the anodizing voltage range (which is considered one of the best state of the art rectifiers for anodizing today) and omitting the shunt resistor (as is the case with the prior art) but using the same load, same test panels and bath as in Example II (that is, a 22% sulphuric acid bath maintained at 30° F.), we observed and determined that a 1.75 mil coating was obtained on the two test panels in twelve 5 minute steps with a maximum voltage of 75 volts. The accumulated output DC kilowatt-hours were about 333 (output kilowatt-hours). Careful watching throughout the run was required to be ready to "back-off" the voltage if necessary to prevent breakdown of the coating signalled by sudden current rises. The oscilloscope picture was complex throughout the run. The following observations were noted.

Example IV Table (Prior Art)

| DC Volts | Current (Amps) (no shunt used) | Time (min.) |
|---|---|---|
| 5 | 2 | 0 |
| 20 | 30 | 5 |
| 23 | 380 | 10 |
| 24 | 550 | 15 |
| 26 | 610 | 20 |
| 28 | 650 | 25 |
| 33.9 | 810 | 30 |
| 37.5 | 810 | 35 |
| 40 | 810 | 40 |
| 45.8 | 810 | 45 |
| 54 | 810 | 50 |
| 64.6 | 810 | 55 |
| 75 | 700 | 60 |

It should be noted that in Example IV above, it took about 20 minutes to reach near the desired anodizing current for the particular load (the identical load as in Example II above).

In respect to Examples II and IV, the following should be noted. Example II most closely compares our "LVA" invention with the prior art (Example IV). In the latter Example (Example IV), a preliminary conditioning of the load is required (of at least 20 minutes) before reaching nearly full anodizing current (610 amps.) In Example II, nearly full anodizing current (620 amps.) is reached immediately. In Example IV, after sixty minutes of anodizing, 1.75 mils of aluminum oxide were formed, while in Example II, 2.0 mils were formed after fifty minutes and with about 50% less output kilowatt-hours required (155 output kilowatt-hours as compared to 333 output kilowatt-hours). Fifty minutes were used in Example II so that the bath run would be more comparable to that in Example IV (where 60 minutes were used). In each case, the bath had to be refrigerated throughout the run to maintain it at 30° F. and, in Example II the refrigeration is considerably less, not only because of the approximate 50% reduction in output kilowatt-hours, but also because part of such heat (kilowatt-hours) is dissipated in the low resistance device outside the bath. Also, since in Example II there is a 60% reduction in the maximum DC anodizing voltage required, there is no danger, during the run, of breakdown of the coating.

It will thus be seen that there has been provided by our invention a new discovery including energy-saving "LVA" process and apparatus in which the aforementioned principal object, together with many thoroughly practical advantages, has been successfully achieved. While a preferred embodiment of our invention has been shown and described, it is to be understood that variations and changes may be resorted to without departing from the spirit of our invention as defined by the appended claims.

The benefits of our "LVA" anodizing process can be realized with chromic acid solutions and the other different electrolytic baths and additives therefor which are presently used in anodizing.

Our invention is applicable, not only to hard coat anodizing as disclosed herein in Examples I to III, but to soft coat anodizing as well. We believe that our invention is also applicable to other metals (than aluminum) capable of forming metal oxides by anodic oxidation.

The product of anodizing with our "LVA" anodizing process is a novel product heretofore unknown in the prior art as witness its desirable properties and the wide selection thereof which can be imparted to the aluminum oxide coating by the anodizing supplier to meet the demands of widely different applications.

What we claim is:

1. A low voltage anodizing process for anodic oxidation of metals in which are used: (i) an anodizing bath containing an electrolyte, an anode and a cathode; and (ii) an AC fed DC power supply for supplying pulsating DC power to the anodizing bath; said anodizing process comprising supplying pulsating D.C. power to the anodizing bath and cyclicly discharging inherent capacitance in the anodizing bath; said cyclic discharge of said inherent capacitance being accomplished by providing successive power cycles wherein each such power cycle consists of a rise portion followed by a fall portion followed by an off-time portion; and providing a shunt discharge path in an electical circuit across the anode and cathode and being external to the anodizing bath for discharging said inherent capacitance during the last part of such fall portion and all during such off-time portion of each power cycle, a significant fraction of the total anodizing current being shunted across said discharge path; said fraction being large enough to completely discharge said inherent capacitance and to empty it of accumulated charges thereon prior to the rise portion of the next subsequent power cycle, there being no capacitor in said electrical circuit across the anode and cathode and external to the anodizing bath.

2. Anodizing apparatus for low voltage anodic oxidation of metals in which are used: (i) an anodizing bath containing an electrolyte, an anode and a cathode; and (ii) an AC fed DC power supply for supplying pulsating DC power to the anodizing bath; said anodizing apparatus comprising means for cyclicly discharging inherent capacitance in the anodizing bath; said DC power supply constructed to provide successive power cycles wherein each such power cycle consists of a rise portion followed by a fall portion followed by an off-time portion; and said means for cyclicly discharging inherent capacitance being an electrical circuit across the anode and cathode and being external to the anodizing bath said means forming a discharge path for discharging said inherent capacitance during the last part of said fall portion and all during said off-time portion of each power cycle, a significant fraction of the total anodizing current being shunted across said discharge path; said fraction being large enough to completely discharge said inherent capacitance and to empty it of accumulated charges thereon prior to the rise portion of the next subsequent power cycle, there being no capacitor in said electrical circuit across the anode and cathode and external to the anodizing bath.

* * * * *